US008770265B2

(12) United States Patent
Nibouar et al.

(10) Patent No.: US 8,770,265 B2
(45) Date of Patent: Jul. 8, 2014

(54) METHOD AND SYSTEM FOR MANUFACTURING RAILCAR COUPLERS

(75) Inventors: F. Andrew Nibouar, Chicago, IL (US); Jerry R. Smerecky, Roselle, IL (US); Kelly S. Day, Sparta, MI (US); Nick Salamasick, Nunica, MI (US)

(73) Assignee: Bedloe Industries LLC, Wilmington, DE (US)

( * ) Notice: Subject to any disclaimer, the term of this patent is extended or adjusted under 35 U.S.C. 154(b) by 0 days.

(21) Appl. No.: 13/339,007

(22) Filed: Dec. 28, 2011

(65) Prior Publication Data

US 2013/0168036 A1 Jul. 4, 2013

(51) Int. Cl.
*B22C 9/08* (2006.01)
*B22C 9/10* (2006.01)

(52) U.S. Cl.
USPC ..... 164/137; 164/359; 164/365

(58) Field of Classification Search
USPC ..... 164/350–351, 359–360, 364–370, 137
See application file for complete search history.

(56) References Cited

U.S. PATENT DOCUMENTS 2,313,517 A * 3/1943 Cameron ..... 164/23
2,334,701 A * 11/1943 Galvin et al. ..... 164/360
2,688,412 A 9/1954 Kulieke
2,699,002 A 1/1955 Sylvestro
2,772,458 A 12/1956 Henry
2,976,588 A 3/1961 Amala et al.
2,997,755 A 8/1961 Olson
3,010,167 A 11/1961 Kozinski
3,496,989 A 2/1970 Paoli
3,683,995 A 8/1972 Zifferer
3,807,483 A 4/1974 Buhler
4,084,705 A 4/1978 Oshinsky et al.
4,097,443 A 6/1978 Nakamura et al.
4,143,701 A * 3/1979 Oshinsky et al. ..... 164/368

(Continued)

FOREIGN PATENT DOCUMENTS

CA 1182272 A 2/1985
CN 201102057 8/2008

(Continued)

OTHER PUBLICATIONS

Rajput, R.K., "A Textbook of Manufacturing Technology: Manufacturing Processes", Oct. 1, 2007, Firewall Media, p. 74-81.*

(Continued)

*Primary Examiner* — Keith Walker
*Assistant Examiner* — Jacky Yuen
(74) *Attorney, Agent, or Firm* — Brinks Gilson & Lione

(57) ABSTRACT

A casting apparatus for casting a railcar coupler, which includes a shank portion and a head portion, includes cope and drag portions that define an external shape of the coupler. The casting apparatus also includes one or more cores that define an interior of the shank portion and a separate head core with an exterior that defines an interior of the head portion that includes lock chamber, guard arm side portion, and knuckle side portions of the head. The head core is a single piece with a hollow center section that defines a front face gating system that includes at least one in-gate configured to direct molten material to top and bottom regions of the head to define the lock chamber, guard arm side portion, and knuckle side of the head.

15 Claims, 19 Drawing Sheets

(56) References Cited

U.S. PATENT DOCUMENTS

| | | | | |
|---|---|---|---|---|
| 4,363,414 | A | 12/1982 | Kaim | |
| 4,641,703 | A | 2/1987 | Voss et al. | |
| 5,038,846 | A | 8/1991 | Doty | |
| 5,299,625 | A * | 4/1994 | Miki | 164/359 |
| 5,385,197 | A | 1/1995 | Sourlier | |
| 5,479,981 | A | 1/1996 | Kim | |
| 5,582,307 | A | 12/1996 | Hawthorne et al. | |
| 6,588,490 | B2 | 7/2003 | Rommel et al. | |
| 7,302,994 | B2 | 12/2007 | Mautino et al. | |
| 2002/0007931 | A1 | 1/2002 | Crafton et al. | |
| 2004/0238152 | A1 | 12/2004 | Campomanes et al. | |
| 2005/0184021 | A1 | 8/2005 | Mautino et al. | |
| 2009/0289024 | A1 | 11/2009 | Nibouar et al. | |
| 2009/0294395 | A1 | 12/2009 | Smerecky | |

FOREIGN PATENT DOCUMENTS

| | | | |
|---|---|---|---|
| CN | 101402131 | A | 4/2009 |
| GB | 2 292 899 | A | 3/1996 |
| GB | 2 300 611 | A | 11/1996 |
| JP | 200417099 | | 1/2004 |
| JP | 2004025210 | | 1/2004 |
| WO | WO 2009/142748 | A1 | 11/2009 |
| WO | WO 2009/142750 | A1 | 11/2009 |
| WO | WO 2009/142757 | A1 | 11/2009 |

OTHER PUBLICATIONS

International Search Report and Written Opinion for International Patent Application No. PCT/US2010/062574, dated May 30, 2011.

International Search Report and Written Opinion for International Patent Application No. PCT/US2012/071719, dated Mar. 7, 2013.

PCT/US2012/71717 Invitation to Pay Fees, mailed Mar. 4, 2013.

PCT/US2012/71717 International Search Report and Written Opinion, mailed May 20, 2013.

Invitation to Pay Fees and Search report for International Patent Application No. PCT/US2012/048002, dated Oct. 25, 2012.

* cited by examiner

METHOD AND SYSTEM FOR MANUFACTURING RAILCAR COUPLERS

BACKGROUND

Railcar couplers are used to connect railcars together. Typical couplers used throughout North America are the Type-EF and Type-F couplers, also referred to as SBE60, SBE69, and or E69 couplers, respectively. These couplers are normally produced through a sand casting process, which offers a low-cost, high-production method for forming complex shapes.

In sand casting, a mold is created using a sand and binder mixture (i.e., molding sand). The binder allows the sand to retain a shape. The most common sand/binder mixture used for casting couplers is green sand, which consists of silica sand, organic binders and water. Green sand is used primarily due to its lower cost.

The mold typically comprises a cope portion (i.e., top half) and a drag portion (i.e., bottom half), which are separated along a straight or offset parting line. To form the cope and drag portions, patterns that define cope and drag portions, respectively, of the coupler and a gating system are placed into separate flasks. Molding sand is then packed around the patterns, to define mold cavities for the coupler and gating system. Draft angles of 3 degrees or more are machined into the pattern to ensure the pattern releases from the mold.

In some instances, two or more couplers may be cast simultaneously by forming the mold around two or more patterns that define multiple couplers in a single flask. For example, two patterns may be arranged side-by-side within the flask. A common gating system may be formed along the longitudinal axis of each pattern and may be configured to feed molten metal to both the head and shank regions of the mold (i.e., those areas of the mold that will correspond to the head and shank sections.)

The patterns are then removed from the mold, and cores for defining various internal cavities of the coupler are placed into the mold. The mold is then closed and filled with hot liquid metal, which is poured into the mold via a down sprue.

After the metal has been poured into the mold, the casting cools and contracts as it approaches a solid state. Risers, which are reservoirs of molten material, are placed at those areas of the casting that exhibit the highest contraction. The risers feed those areas as the casting cools to help minimize the formation of voids, which would otherwise occur. The risers are formed in the cope portion of the mold and typically define openings, which may allows gasses to escape during pouring and cooling.

After solidification, the metal (i.e., raw casting) is removed by breaking away or burning off the rigging. The casting is then finished and cleaned via grinders, blasting, welding, heat treatment, or machining.

The casting techniques described above have several disadvantages. First, the binders used in the in the molding sand can have a significant effect on the final product, as they control the dimensional stability, surface finish, solidification, and casting detail achievable in each specific process. In particular, couplers cast in green sand have a relatively poor dimensional stability and surface finish. These couplers may also exhibit a higher rate of defects due to solidification issues.

As noted above, two or more couplers are sometimes formed in a single flask. However, the size of the flask has to be relatively large because of the way in which the gating system is arranged with respect to the coupler cavities. Other problems with these casting operations will become apparent upon reading the description below.

BRIEF SUMMARY

An object of the invention is to provide a casting mold with the rigging and/or gating system for casting a railcar coupler. The railcar coupler includes a shank portion and a head portion. The casting mold includes cope and drag portions that define an external shape of the coupler. The casting mold assembly also includes one or more cores that define an interior of the shank portion and a separate head core with an exterior that defines at least an interior of the head portion including the lock chamber, guard arm side portion, and knuckle side portions of the head. The head core comprises at least one portion that defines a front face gating system that includes a channel that runs in a generally vertical direction through a center of the portion and at least one in-gate configured to direct molten material to top and bottom regions of the head to define the lock chamber, guard arm side portion, and knuckle side of the head.

Another object of the invention is to provide the casting mold with the rigging for casting a railcar coupler that includes a shank portion and a head portion. The casting mold includes cope and drag portions that define an external shape for each of at least two couplers. The couplers are nested together and oriented in opposite directions to one another along respective longitudinal axes. A down sprue is centered between the first and second couplers and is configured to direct molten material to a gating system positioned between the at least two couples.

Another object of the invention is to provide a casting method for casting a railcar coupler. The coupler includes a shank portion and a head portion. The casting method includes providing cope and drag portions of the mold that define an external shape of the coupler, providing one or more cores that define at least an interior of the shank portion, and providing a separate head core with an exterior that defines an interior of the head portion including the lock chamber, guard arm side portion, and knuckle side portions of the head. The head core comprises at least one portion that defines a front face gating system that includes a channel that runs in a generally vertical direction through a center of the at least one portion and at least one in-gate configured to direct molten material to top and bottom regions of the head to define the lock chamber, guard arm side portion, and knuckle side of the head.

Another object of the invention is to provide a casting method for casting a railcar coupler. The coupler includes a shank portion and a head portion. The casting method includes providing cope and drag portions of the mold that define an external shape for each of at least two couplers. The couplers are nested together and oriented in opposite directions to one another along respective longitudinal axes. Also provided is a down sprue that is centered between the first and second couplers configured to direct molten material to a gating system positioned between the at least two couplers.

Other features and advantages will be, or will become, apparent to one with skill in the art upon examination of the following figures and detailed description. It is intended that all such additional features and advantages included within this description be within the scope of the claims, and be protected by the following claims.

BRIEF DESCRIPTION OF THE DRAWINGS

The accompanying drawings are included to provide a further understanding of the claims, are incorporated in, and constitute a part of this specification. The detailed description and illustrated embodiments described serve to explain the principles defined by the claims.

FIG. 13 B illustrates an angle formed between the end of the shank and a tail riser;

DETAILED DESCRIPTION OF THE DRAWINGS

Figure 1:
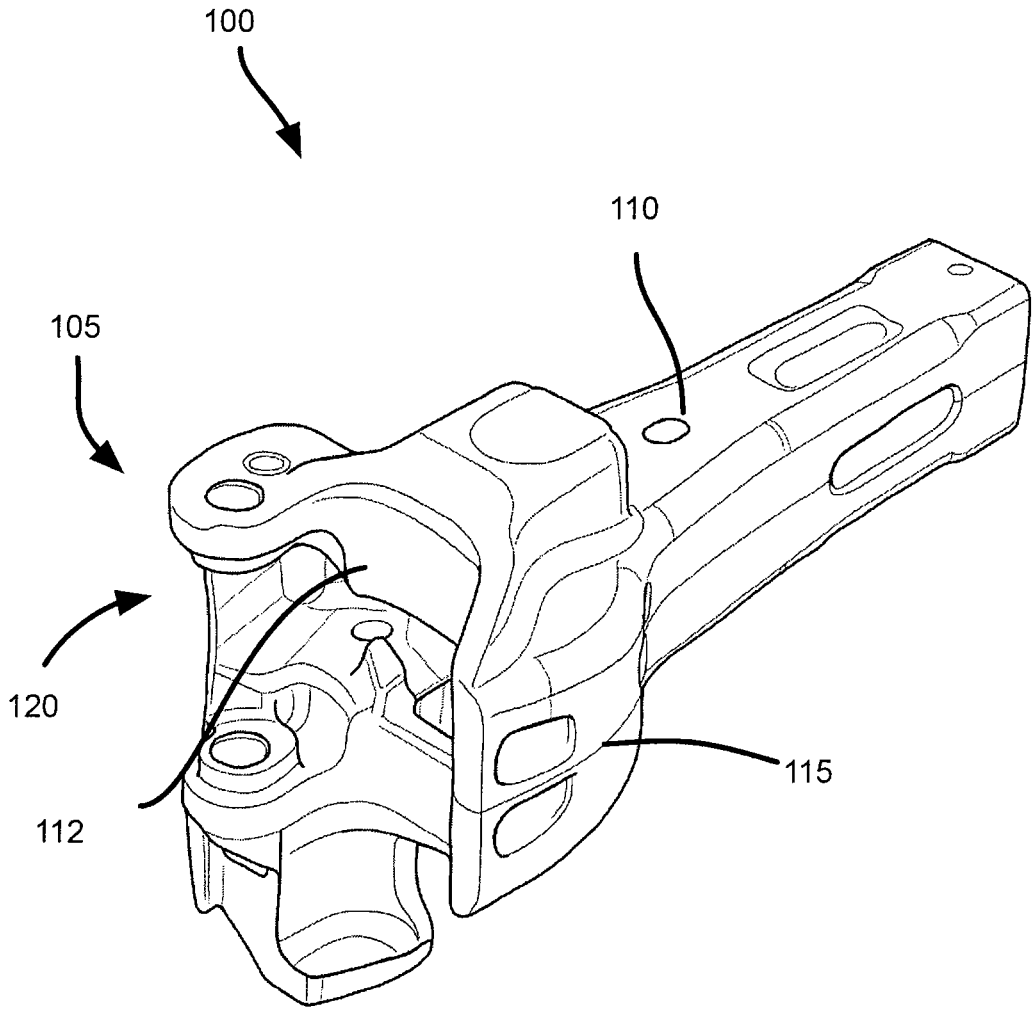
FIG. 1 illustrates a perspective view of a first railcar coupler embodiment.

The embodiments below generally describe a rigging system for manufacturing railcar couplers. The rigging may be arranged within an outer mold that includes a cope portion and a drag portion. The cope and drag portions may be formed from a relatively low-cost molding material, such as no-bake or air-set sand, which may have a grain fineness number (GFN) in the range of 44-55 GFN. The molding material may be new sand or reclaimed sand. That is, sand that has been previously used to make castings. The reclaimed sand may be obtained by subjecting used molds to various shaking, thermal, and/or crushing operations that break down the sand into finer and finer constituent sizes until a desired grain size is obtained. Screening operations facilitate separation of the sand by size. Finally, the sand is subjected to high temperatures to burn off any residual coating or other impurities, such as the binder material. The reclaimed sand is then mixed with new binder at a ratio of about 99:1 and placed into a mold and allowed to set. Once set, the new mold is ready to receive a molten material.

In some implementations, two or more grades of molding material may be used to form the outer mold. For example, an outer layer of the mold (i.e., that defines the exterior of the outer mold may be formed from less-refined sand and/or relatively small blocks broken from used molds. The less-refined material may not be subjected to the various separation operations described above. For example, thermal operations may not be carried out to save time. Moreover, a lesser amount of binder material may be utilized to bind the less-refined material. For example, the ratio of sand to binder may be greater than 99:1.

An inner layer of the mold may be formed from the more-refined sand reclaimed via the separation processes described above. Utilizing the different grades of reclaimed material reduces overall manufacturing costs associated with the outer mold as less refined sand is required. The more-refined sand may be reserved for just those portions of the mold that require improved surface finish and/or greater dimensional accuracy, such as the internal cavities, gating system, and the like.

The disclosed rigging system includes a one-piece head core 225 that defines the interior of the head of a coupler along with a front face gating system that is configured to feed molten material throughout the head. While a one-piece head core is shown, it is understood that the head core could comprise more than one portion.

The rigging system also facilitates the casting of two couplers via a common gating system positioned in-between the couplers. In particular, two rigging system embodiments are disclosed. The first embodiment is configured to cast Type E couplers. The second embodiment is configured to cast longer Type EF couplers. For example, the first embodiment may be used for casting SBE60EE and SBE67DE couplers. The second embodiment may be used for casting E69CE, EF601AE, EF528CE, SBE69CE, and EF5110E. It is understood, however, that these casting embodiments may be adapted to cast a greater number of couplers simultaneously and/or different types of couplers.

FIG. 1 illustrates a perspective view of a first railcar coupler embodiment 100 (coupler 100) that may be cast using the outer mold and gating system, described above. The coupler 100 may generally include the features of an SBE 60 coupler. For example, the coupler 100 includes a head 105 and shank 110 with a length of about 21.5 in. The head 105 includes a front face 112, guard arm side portion 115, and a knuckle side portions 120.

Figure 2:
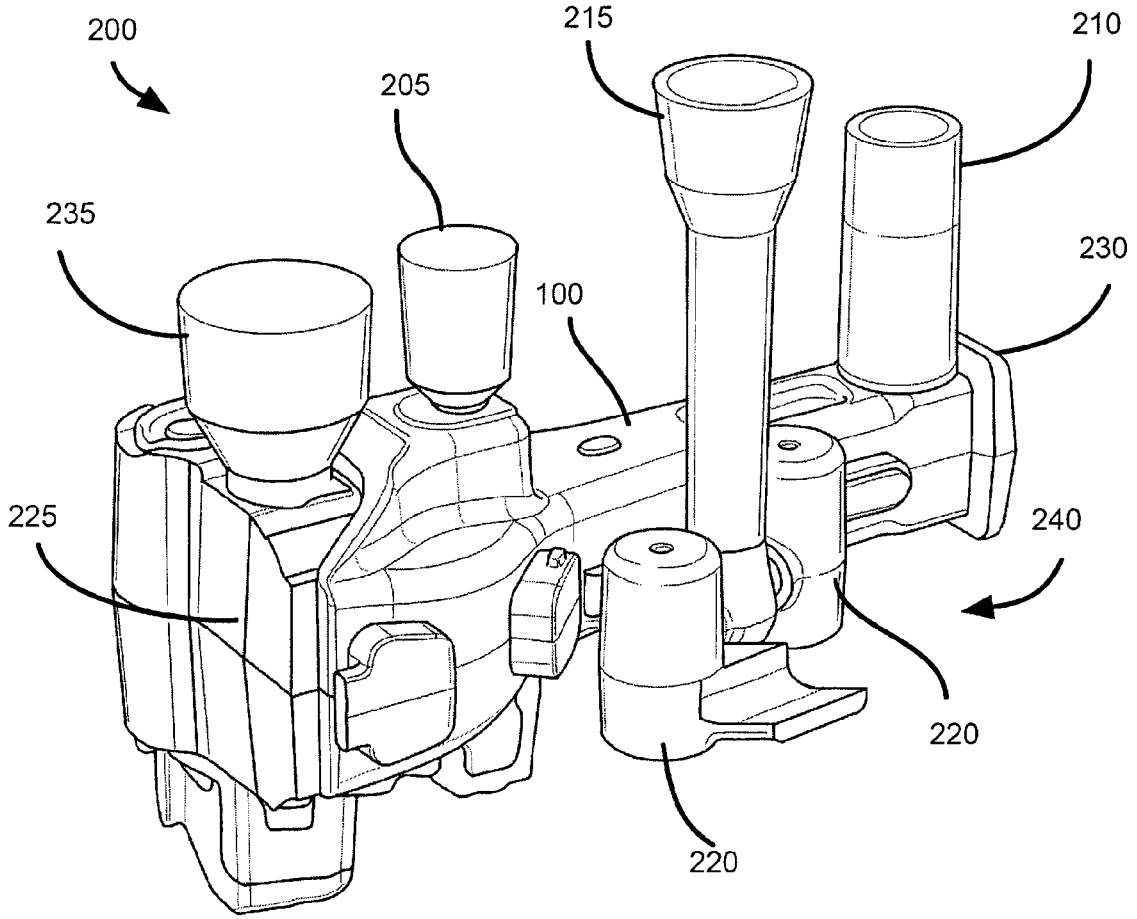
FIG. 2 illustrates a partial view of rigging and cores for the coupler of FIG. 1 in relation to the coupler.
Figure 3:
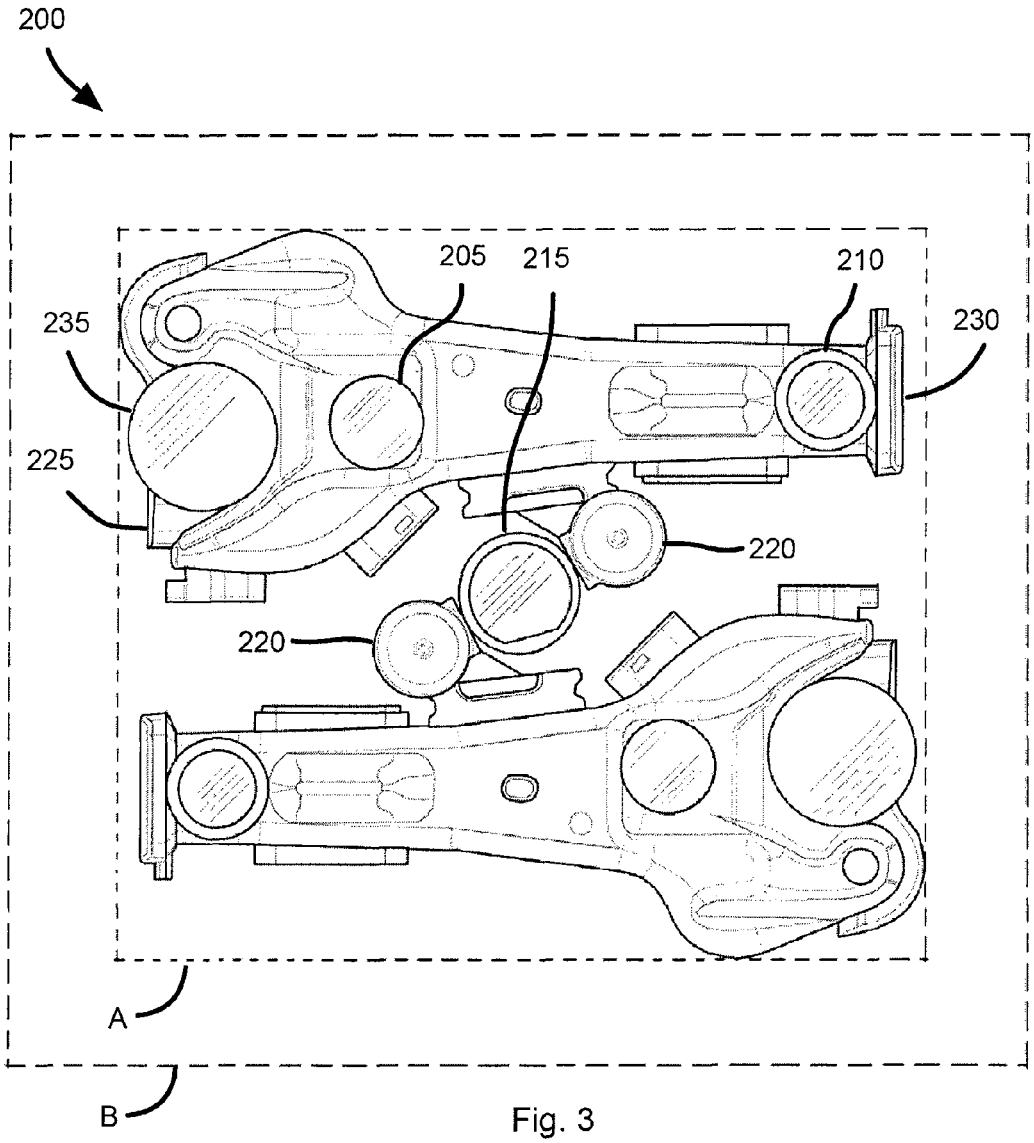
FIG. 3 illustrates rigging for casting two couplers simultaneously.

FIG. 2 illustrates a partial view of rigging 200 used for casting a pair of couplers 100 in relation to a single coupler 100 and FIG. 3 illustrates the rigging 200 in relation to the pair of couplers 100. The two couplers 100 are nested together and oriented in opposite directions along respective longitudinal axes. When arranged in this manner, the couplers fit within a bounding rectangle that has a square area A of less than about 10 $ft^2$ and/or a mold that has a square area B of less than 13 $ft^2$, when viewed from above (i.e., in a direction perpendicular to a top surface of the mold,) as illustrated in FIG. 3.

Referring to the figures, the rigging 200 includes a head core 225 and a butt-end core 230. The head core 225 is configured to define interior features of the coupler 100. The butt-end core 230 is configured to define the exterior features of the back end of the shank 110. The head core 225 may be formed from one unitary body of material or may be formed from smaller core sections that combine to form the head core 225. Other cores for defining other interior features may be provided. Further details of the head core 225 and butt-end core 230 are described in U.S. application Ser. No. 13/337,558, which is incorporated by reference in its entirety.

The rigging 200 also includes a front face riser 235, a knock-off top riser 205, a tail riser 210, a down sprue 215, and a gating system 240. The outer mold defines the exterior features of the coupler 100 along with various portions of the rigging 200 including the gating system 240, knock-off top riser 205, and tail riser 210, front face riser 235, and down sprue 215.

The tail riser 210 has a height of about 10.9 in and a top diameter of about 5 in that tapers to a smaller diameter towards the coupler 100. The tail riser 210 is positioned over the tail end of the shank 110 of the coupler 100, and is configured to feed molten material to the solid tail end of the shank 110 while the casting cools.

Figure 4:
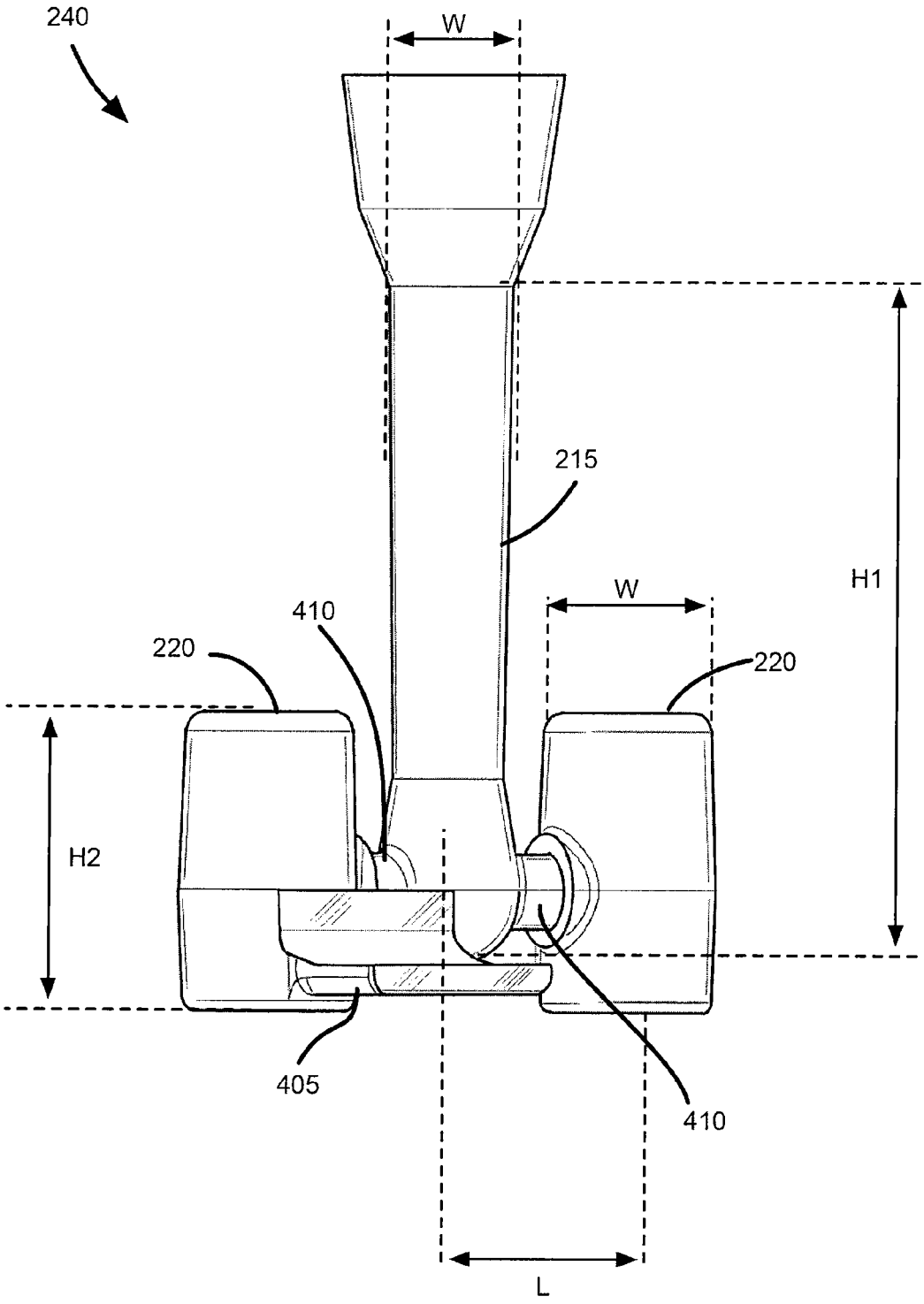
FIG. 4 illustrates a side view of a gating system for casting the couplers.

FIG. 4 illustrates a front view of the gating system 240. The gating system 240 is generally arranged between and adjacent to the shanks 110 of the two couplers 100. The gating system 240 includes the down sprue 215. The gating system 240 also includes a pair of runners 410, a pair of risers 220, and a pair of fin shaped in-gates 405, herein after referred to as fin in-gates 405. The down sprue 215 may have a height H1 of about 23.9 in and a diameter of about 3 in. Each riser 220 is positioned at an intersection of a respective runner 410 and fin in-gate 405 and may have a height H2 of about 8 in and a width W of about 4.8 in. The length L of each runner 410 when measured between the center of the down sprue 215 and the center of a respective riser 220 may be about six in and have a diameter of about 2 in.

Figure 5A:
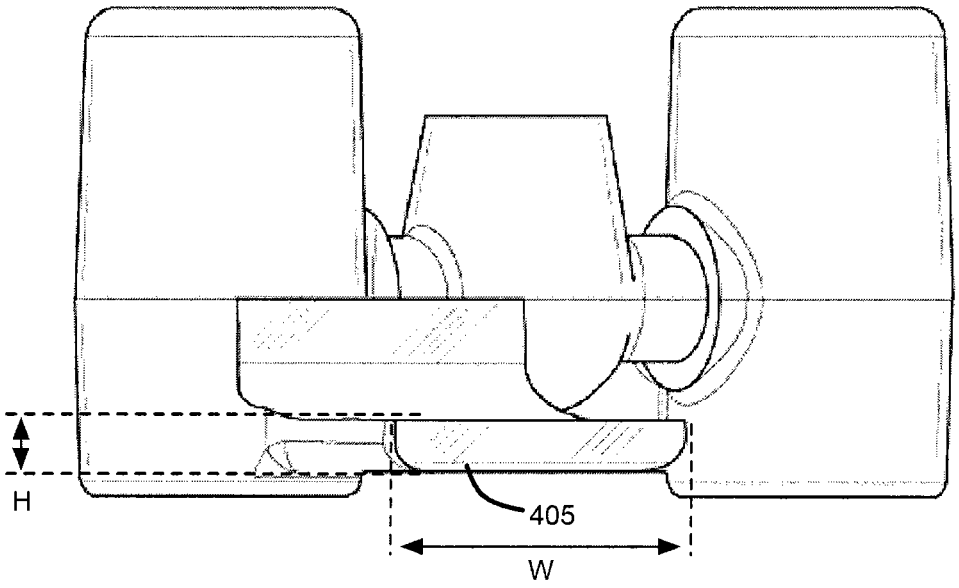
FIG. 5*a* illustrates a side view of fin in-gates of the gating system.
Figure 5B:
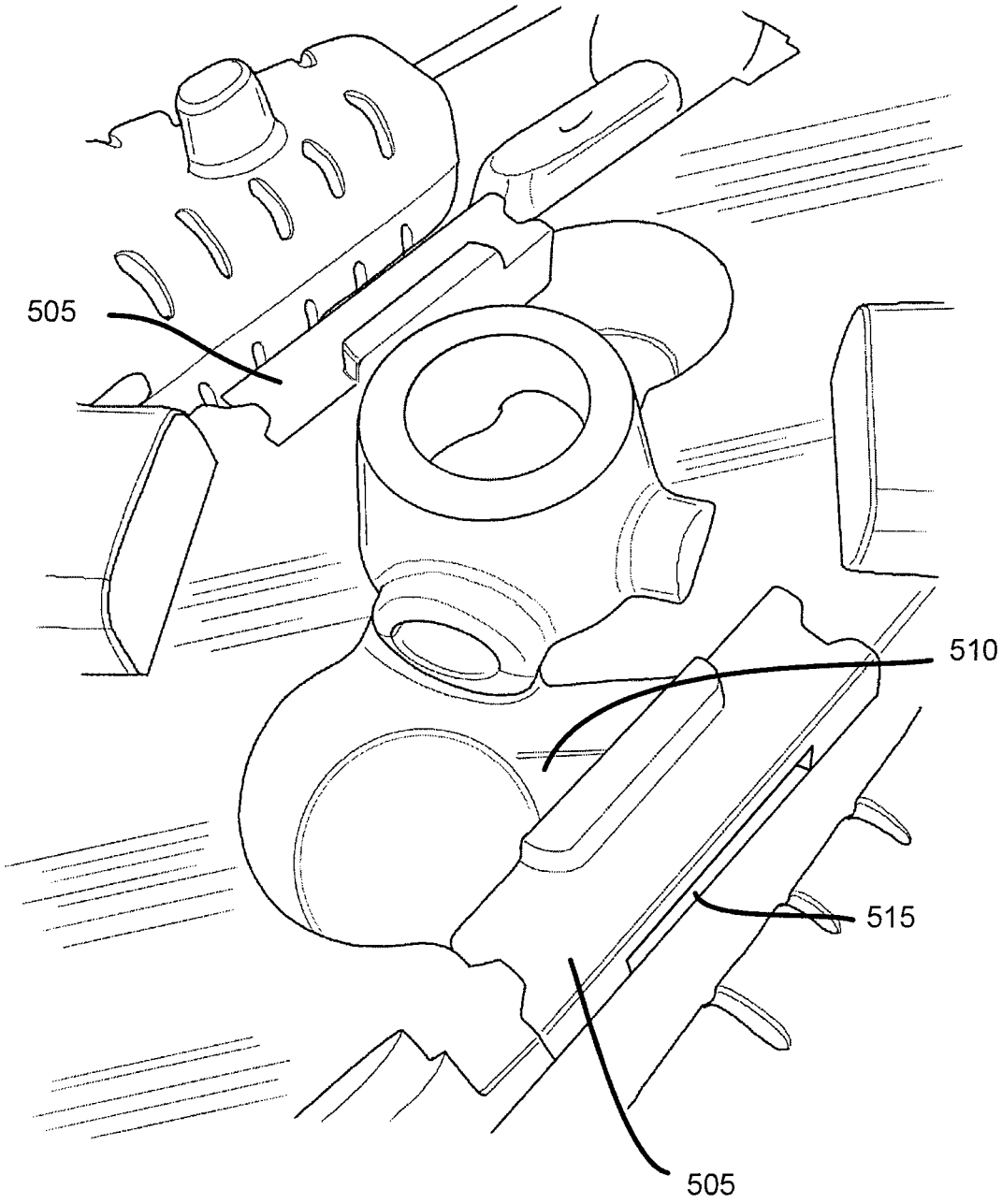
FIG. 5*b* illustrates a section of the drag mold that forms that the fin in-gates.
Figure 6:
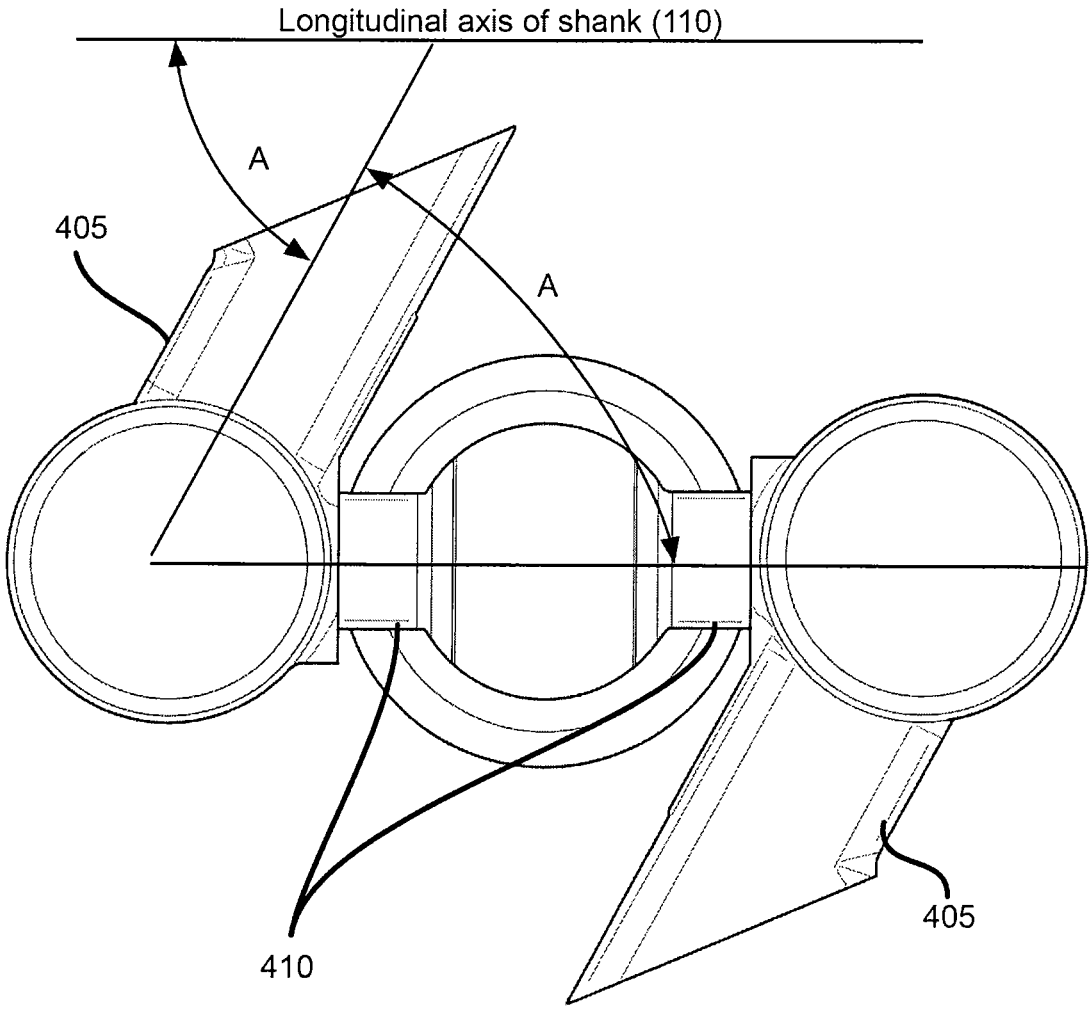
FIG. 6 illustrates a bottom view of the gating system.

The fin in-gates 405 may be entirely formed in the drag portion of the outer mold. Referring to FIG. 5*a*, each fin in-gate 405 may have a height H of about 0.8 in and a width W of about 4.8 in. As illustrated in FIG. 6, the longitudinal axis of a given fin in-gate 405 may form an angle A of about 60 degrees with the longitudinal axis of a runner 410. Likewise, the angle formed between the longitudinal axis of a given fin in-gate 405 and the longitudinal axis of the shank 110 of the coupler 100 may be about 60 degrees. The fin in-gates 405 are positioned nearest the corner/heaviest location of the shank 110. For example, the fin in-gates 405 may feed the shank from a bottom side of the shank or a lower end of a side of the shank that is nearest the down sprue.

In some implementations, the fin cores 505 are formed by an opening 515 defined between a fin core 505 and an in-gate channel 510 of the drag portion. The fin cores 505 are configured to be inserted into in-gate channels 510 of the drag portion. Each fin core 505 and in-gate channel 510 combination defines an opening 515 that matches the cross-sectional width and height of a fin in-gate 405.

Figure 7:
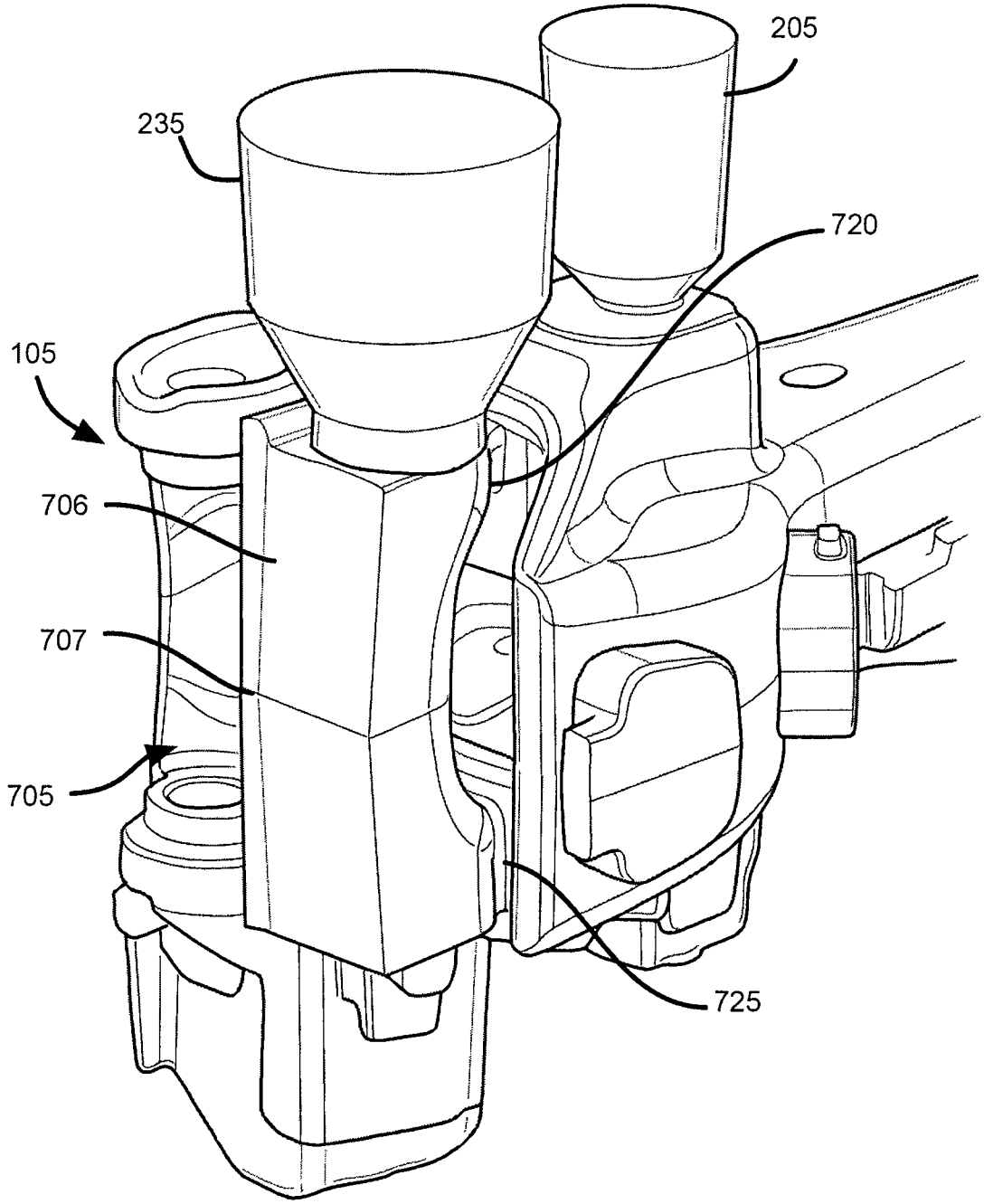
FIG. 7 illustrates a face gating system of the coupler.
Figure 8:
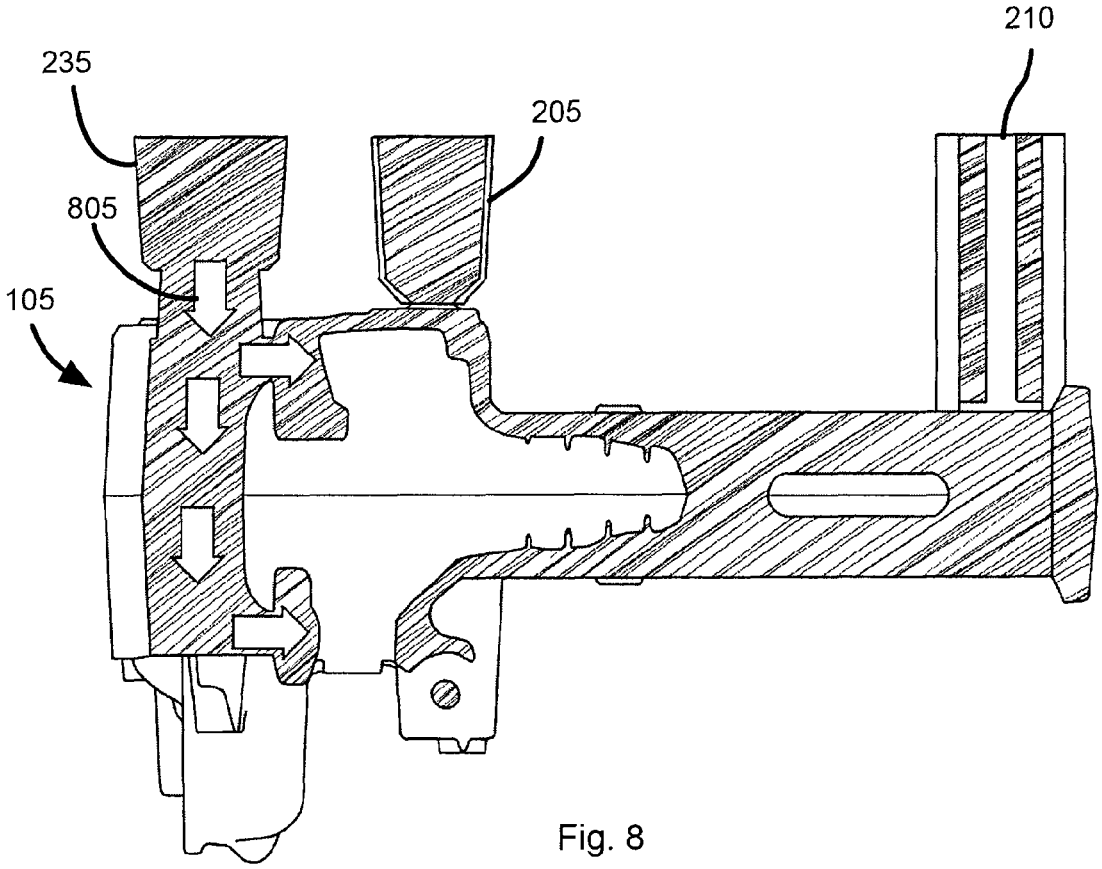
FIG. 8 illustrates the flow of molten material from a front face riser through a gating system of the head core as the casting solidifies.

FIGS. 7 and 8 illustrate cross-sectional views of the head 105 of the cast coupler 100 with rigging. As noted above, the rigging 200 includes a front face riser 235 and knock-off top riser 205. The front face riser 235 and the knock-off top riser 205 may be defined in the cope portion of the outer mold. The front face riser 235 is positioned over an opening in the top of the head core 225. The knock-off top riser 205 is positioned over the upper lock chamber of the coupler 100.

Referring to FIG. 1, the head core 225 defines the interior surface of the head 105 of the coupler 100, which includes the front face 112, guard arm side portion 115, and knuckle side portions 120, of the head 105. The head core 225 also defines a front face gating system for feeding molten material throughout the head 105. The shape defined in the head core 225 is illustrated by way of its corresponding cast version 705, illustrated in FIG. 7. Referring to the cast version of the front face gating system 705, the front face gating system 705 includes a channel 706 in a center region that is connected to upper and lower in-gates 720 and 725. The upper in-gate 720 and a lower in-gate 725 are configured to feed molten material into upper and lower sections, respectively, of the front face of head 105 at the same time, as illustrated by the arrows 805 shown in the side-view of FIG. 8. The upper in-gate 720 may be positioned within the cope portion of the outer mold. The lower in-gate 725 may be positioned within the drag portion of the outer mold. The front face riser 235 is positioned over and generally centered with the vertical axis of the channel 706.

Figures 9A, 9B:
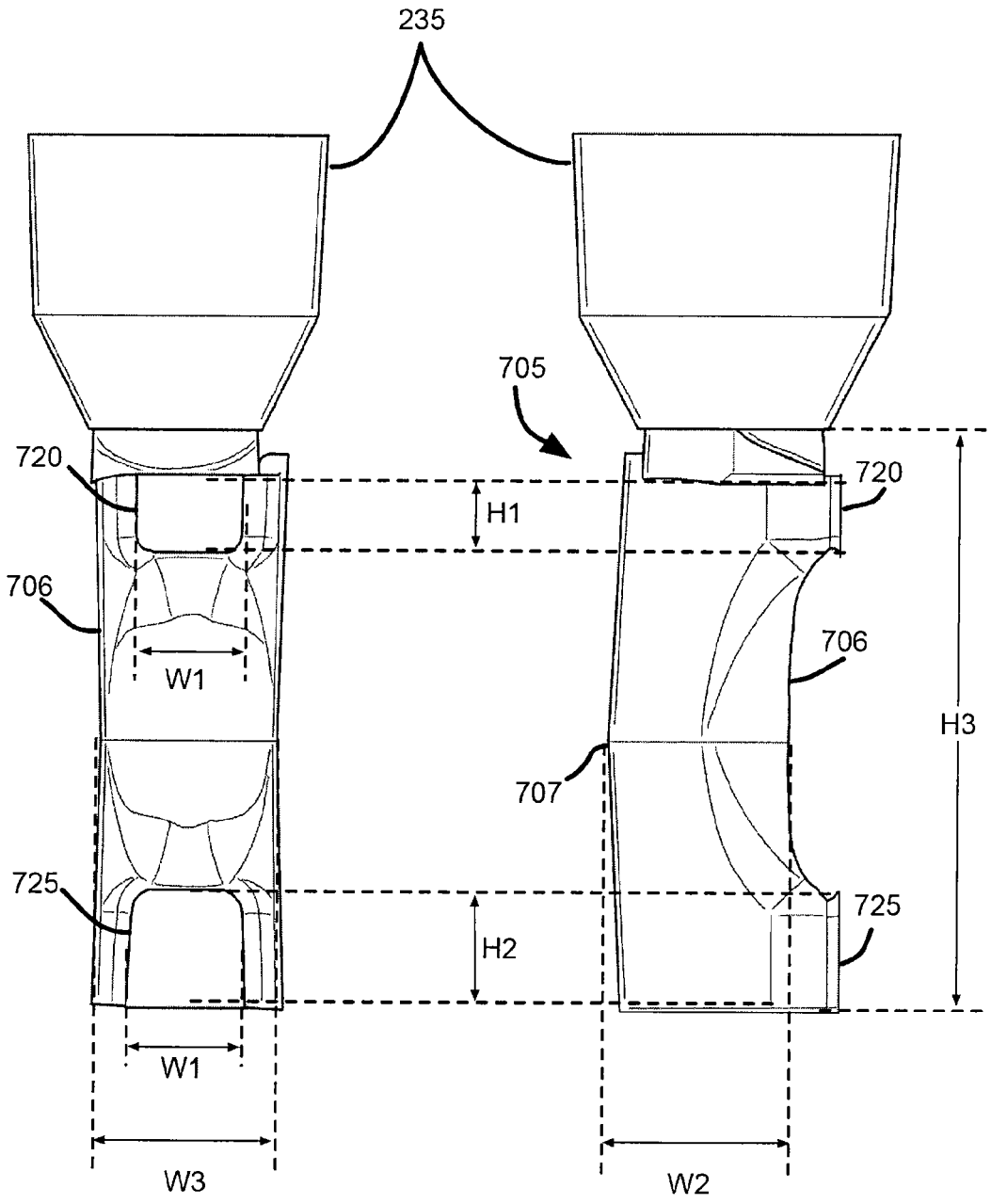
FIGS. 9A and 9B illustrate side and back views, respectively, of the gating system of the head core.

Referring to FIGS. 9A and 9B, the upper in-gate 720 may have a height H1 and width W1 of about 1.8 in and 2.6 in, respectively, or may have a cross-section of at least 4.6 $in^2$. The lower in-gate 725 may have a height H2 and width W2 of about 2.7 in and 2.9 in, respectively, or may have a cross-section of at least 7.8 $in^2$. A center region of the channel 706 may have a cross-section W2×W3 (4×4.3) of about 16 $in^2$ near the parting line 707 of the channel 706. The height H3 of the channel 706, may be between about 10 and 15 in. For example, in one implementation, the height H3 may be about 13 in. The relatively small sizes of the upper and lower in-gates 720 and 725 facilitate removal of the gating system 705 via impact. For example, an impact hammer may be utilized to break the gating system 705 away from the coupler. The residual casting material may on the front face then be ground down to produce a smooth finish as compared to air carbon arc cutting, which typically leaves more material on the casting resulting in more labor and time to finish the casting.

Figure 10:
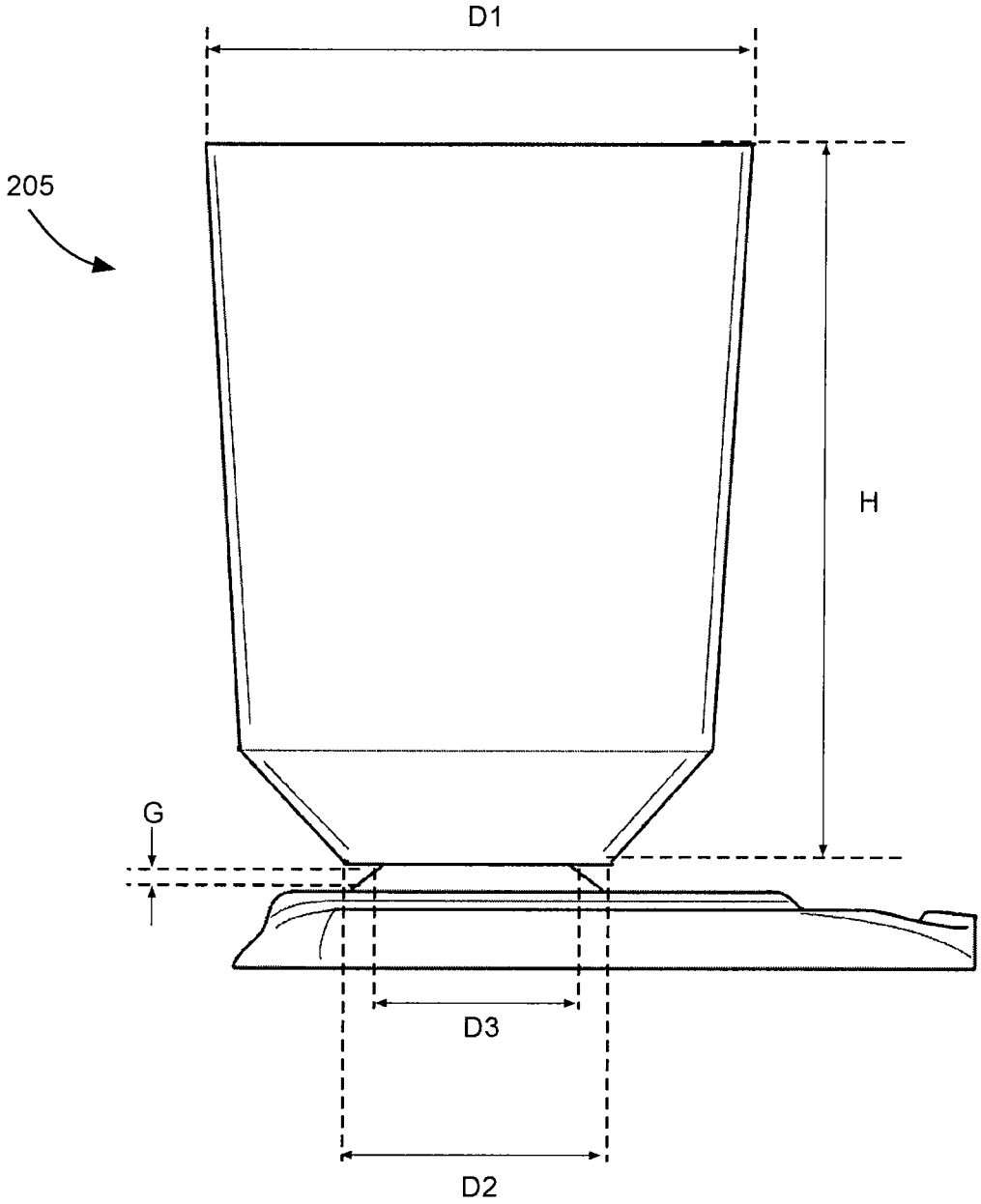
FIG. 10 illustrates a knock-off top riser of the coupler casting.

Referring to FIG. 10, the knock-off top riser 205 may have a generally cylindrical shape with slight tapering of the sidewall. The height H of the knock-off top riser 205 may be about 6.7 in. The diameter D1 of the top of the knock-off top riser 205 may be about 4.6 in. Towards the bottom of the knock-off top riser 205, the amount of tapering increases rapidly such that the bottom surface of the knock-off top riser 205 has a diameter D2 of about 2 in. The contact area between the riser and the uppers surface of the coupler 100 may have a diameter D3 of about 1.5 in. A gap G of about 0.25 in may be formed between the bottom surface of the knock-off top riser 205 and the top surface of the coupler 100. Tapering of the knock-off top riser 205 to a relatively small diameter facilitates removal of the knock-off top riser 205 via impact. For example, a hammer may be utilized to break the knock-off top riser 205 away from the coupler 100. The residual casting material may then be ground down to produce a smooth finish on the top of the coupler 100.

In operation, molten material is poured into the down sprue 215. The molten material then flows through the runners 410, through the fin in-gates 405 and then fills the cavities between the cores and the outer mold to define the couplers 100. As the cavity fills, the risers 220 begin to fill. The relative angles formed between the runners 410, fin in-gates 405, and shank 110, along with the dimensions of the fin in-gates 405, control the rate and location at which molten material flows in the respective cavities that define the first and second couplers 100, illustrated in FIG. 3. That is, the relative angles and dimensions of the members tend to control and/or restrict the flow of molten material such that the molten material flows evenly and with a minimum of turbulence into the respective cavities that form the couplers 100.

The molten material continues to fill the various components that define the head 105. For example, the molten material fills the knock-off top riser 205 and then the front face riser 235. As the casting solidifies, the molten material in the front face riser 235 flows through the front face gating system 705 and through the upper and lower in-gates 720 and 725 to fill the cavities that define the interior of the head 105.

As the molten material cools and begins to contract, molten material in the risers 210 and 205 and the front face riser 235 continue to flow into the cavities to thereby prevent voids from forming in the casting.

After the material hardens, the gating system 240, front face gating system 705, risers 210 and 205, and front face riser 235 may be removed from the cast coupler 100. The relatively small cross-section of the fin in-gates 405 facilitates easy separation of the fin in-gates 405 and, therefore, the gating system 240, from the cast coupler 100. For example, a relatively low amount of torque may be applied to the gating system 240 relative to the coupler 100 to simply crack the gating system 240 off of the coupler 100. The knock-off top riser 205 and the front face gating system 705 may be removed via impact or the like. The remaining portions of the casting (i.e., the gating system, risers, down sprue, etc.) may be melted down and used in subsequent casting operations.

As described above, the casting system advantageously allows for the casting of two couplers 100 in a single casting operation. Due to relative positioning of the couplers 100 and the gating systems 240 and 705, the size of the outer mold can be kept to a minimum. For example, the surface area of the cope of the outer mold may be about 13 $ft^2$ as illustrated by reference B in FIG. 3.

Figure 11:
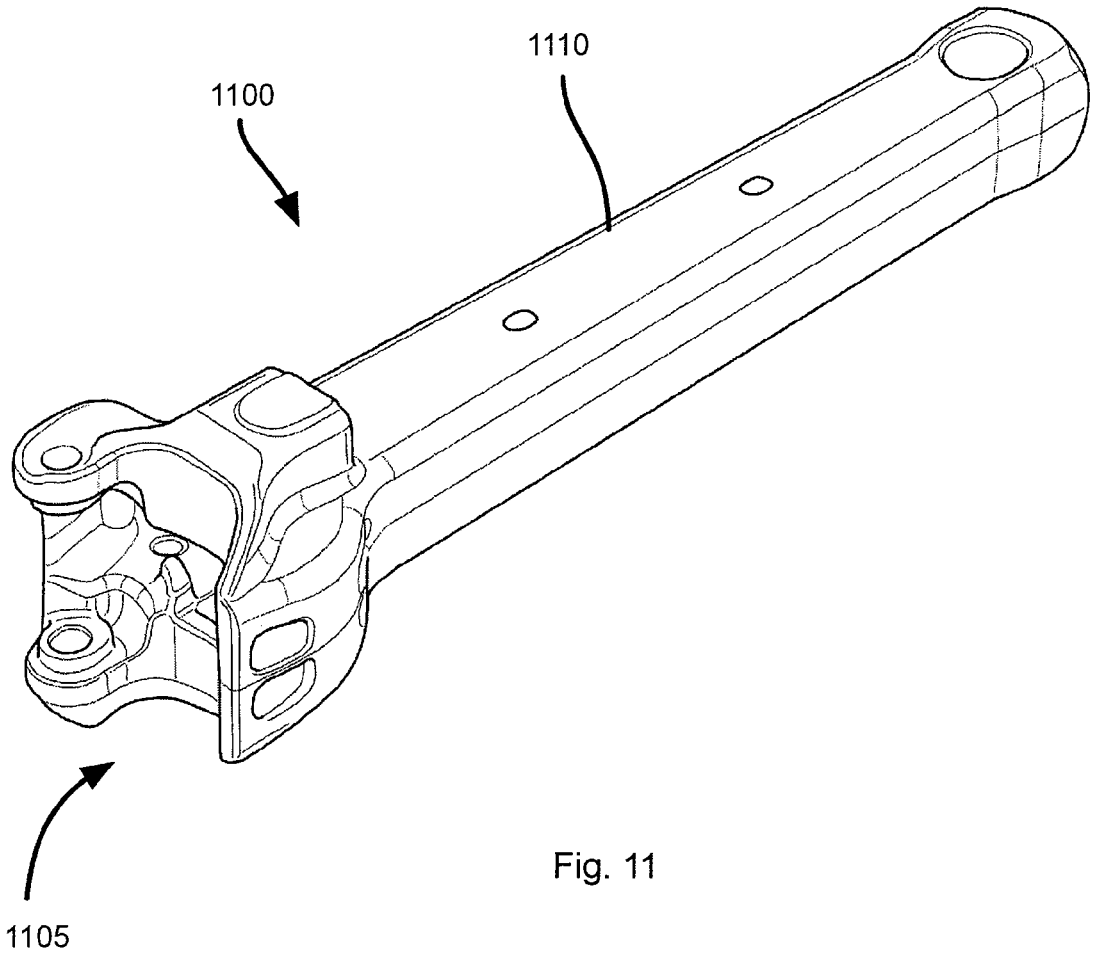
FIG. 11 illustrates a perspective view of a second railcar coupler embodiment.

FIG. 11 illustrates a perspective view of a second embodiment of a railcar coupler 1100. The coupler 1100 may generally include the head 1105 of a Type E coupler and the shank 1110 of a Type F, which is longer than the shank 110 of the Type E coupler 100, described above, has a different pin arrangement for locking into a train car, and does not have a bottom shelf as configured.

Figure 12:
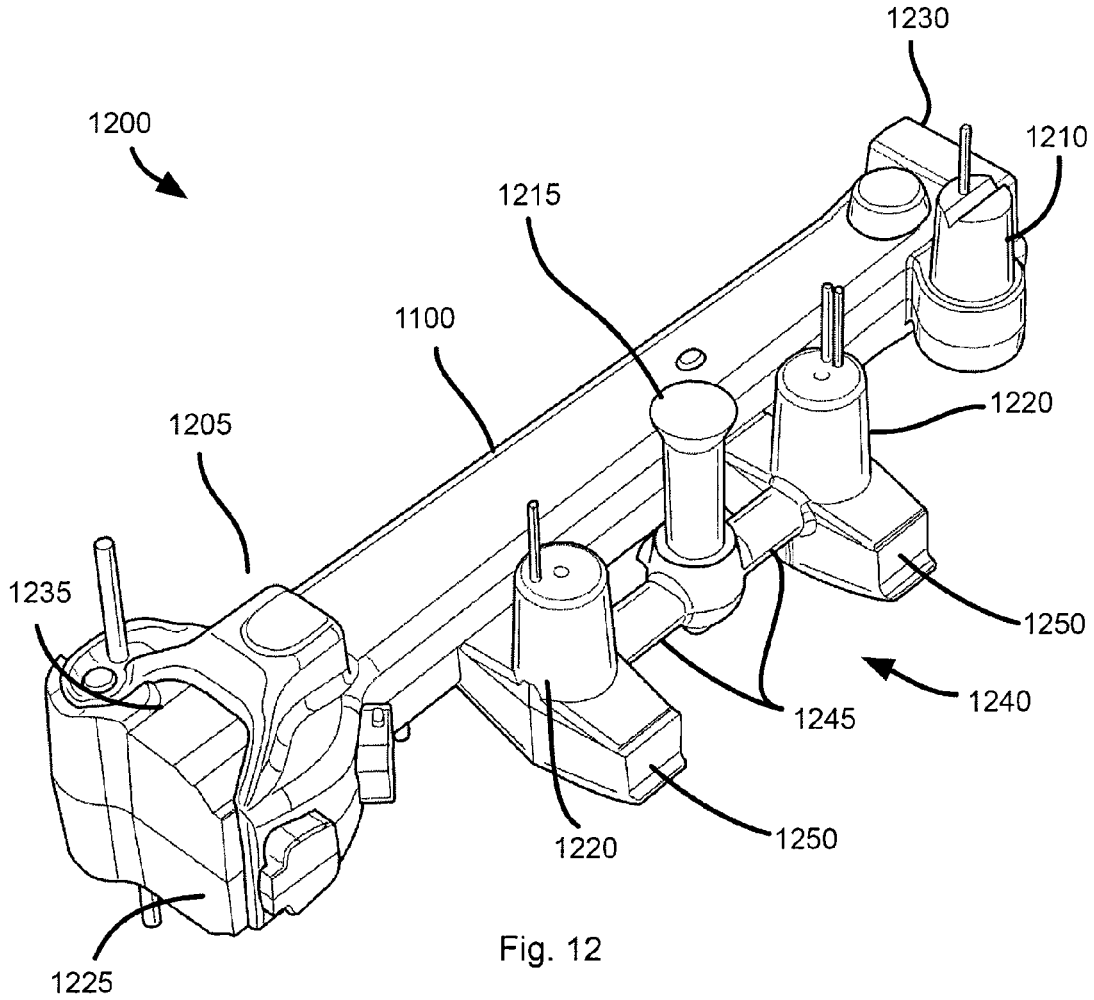
FIG. 12 illustrates a partial view of rigging for the coupler of FIG. 11 in relation to the coupler.
Figure 13A:
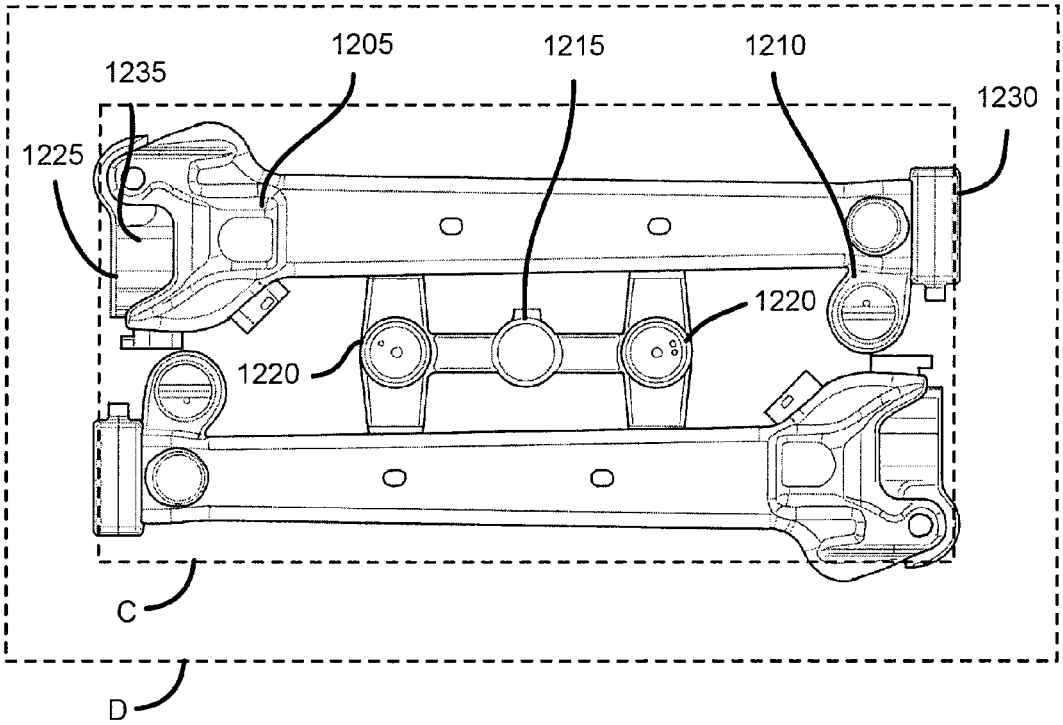
FIG. 13 A illustrates rigging for casting two couplers simultaneously.

FIG. 12 illustrates a partial view of rigging 1200 used for casting a pair of couplers 1100 in relation to a single coupler 1100. The second coupler is omitted in FIG. 12 to show details of the rigging. FIG. 13A illustrates the rigging 1200 in relation to the pair of couplers 1100. The respective figures generally illustrate the coupler 1100 and rigging 1200 after removal from an outer mold (not shown). The two couplers 1200 are nested together and oriented in opposite directions along respective longitudinal axes. When arranged in this manner, the couplers fit within a bounding rectangle that has a square area C of less than about 18 $ft^2$ and/or a mold that has a square area D of less than 23 $ft^2$, when viewed from above (i.e., in a direction perpendicular to a top surface of the mold,) as illustrated in FIG. 13A.

Referring to the figures, the rigging 1200 includes a head core 1225 and a butt-end core 1230. The head core 1225 is configured to define interior and exterior features of the coupler 1100. The butt-end core 1230 defines the exterior features of the back end of the shank 1110. Other cores for defining other interior features may be provided. Further details of the head core 1225 and butt-end core 1230 are described in U.S. application Ser. No. 13/337,558, which is incorporated by reference in its entirety.

The rigging 1200 also includes a front face riser 1235, a knock-off top riser 1205, a tail riser 1210, a down sprue 1215, and a center gating system 1240. The outer mold defines the exterior features of the coupler 1100 along with various portions of the rigging 1200, including the center gating system 1240, knock-off top riser 1205, tail riser 1210, front face riser 1235, and a down sprue 1215.

The head 1105 may be cast in a similar manner as described above. For example, a head core 1225 may define interior features of the head 1105 and may include a cavity and in-gates configured to feed molten material through the head 1105. A knock-off top riser 1205 and front face riser 1235 feed molten material to the head 1105 as the casting cools.

Figure 14:
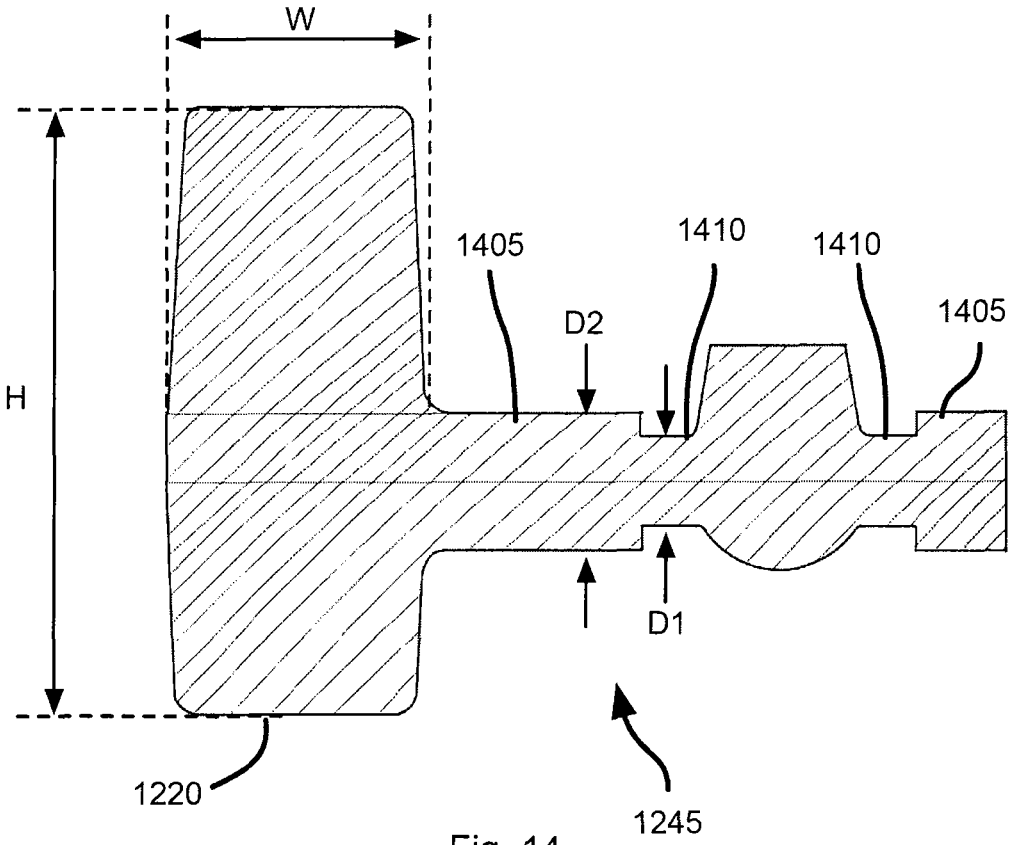
FIG. 14 illustrates a front section side view of a gating system for casting the couplers.

The center gating system 1240 includes a down sprue 1215, a pair of runners 1245, a pair of risers 1220, and a pair of in-gates 1250. The dimensions of the down sprue 1215 may be about the same as the down sprue 215 illustrated in FIG. 4, which is described above. Referring to FIG. 14, each riser 1220 may have a height H of about 13 in and a width W of about 5.8 in. The center gating system 1240, or more specifically, the down sprue 1215, may be generally aligned with a midpoint of the shank 1110.

Figure 15:
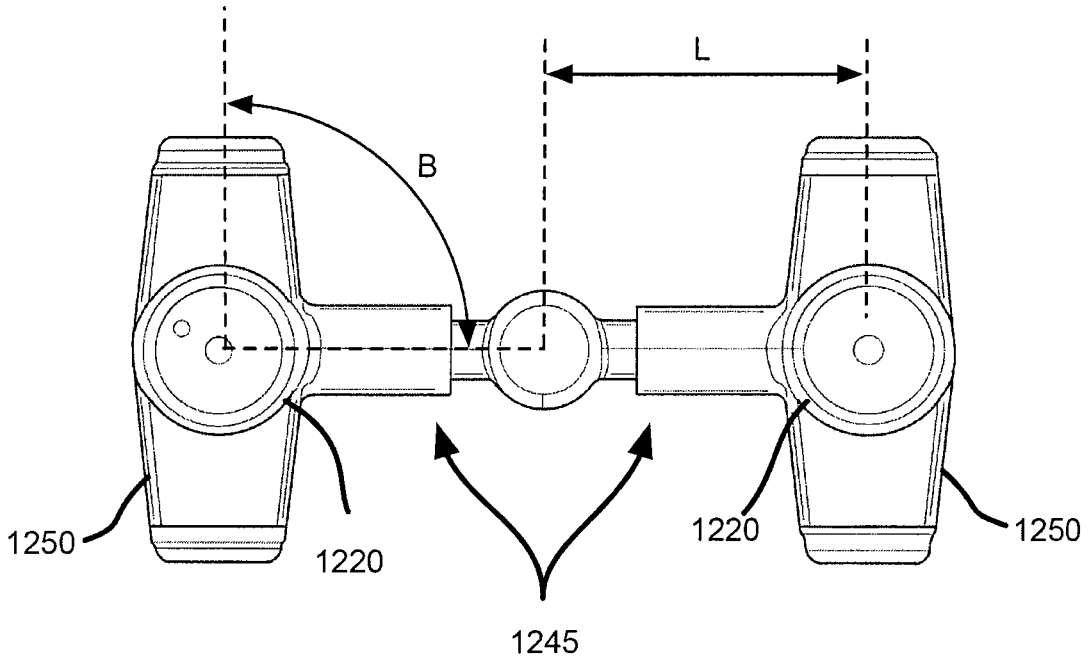
FIG. 15 illustrates a top view of the gating system and in-gates of the gating system.

The runners 1245 couple the down sprue 1215 to the risers 1220 and run in a direction that is generally parallel to a longitudinal axis of the shank 1110. In a first runner section 1410 that connects to the down sprue, the diameter D1 of each runner 1245 is about 2.0 in. In a second runner section 1405 that connects to a riser, the diameter D2 of each runner 1245 is about 3.1 in. Referring to FIG. 15, the length L of each runner 1245, when measured between respective centers of the down sprue 1215 and risers 1220, may be about 10.6 in.

The in-gates 1250 are coupled to first and second sections of the shank 1110 to facilitate more even distribution of molten material to the shank 1110 of the coupler 1100. A first in-gate is positioned between the midpoint of the shank 1110 and the head 1105. A second in-gate is positioned between the midpoint of the shank 1110 and the opposite end of the coupler 1100. This double feed to the shank 1110 facilitates even filling and cool down of the shank 1110 of the coupler 1100. The in-gates 1250 shown in the figures enter the shank 1110 from a side of the shank 1110. However, in alternative embodiments, the in-gates 1250 may be configured to enter the shank 1110 from a bottom side of the shank 1110 to bottom-feed the coupler. The principles and advantages of bottom feeding are described in U.S. application Ser. No. 13/194,704, which is hereby incorporated by reference.

Figure 13B:
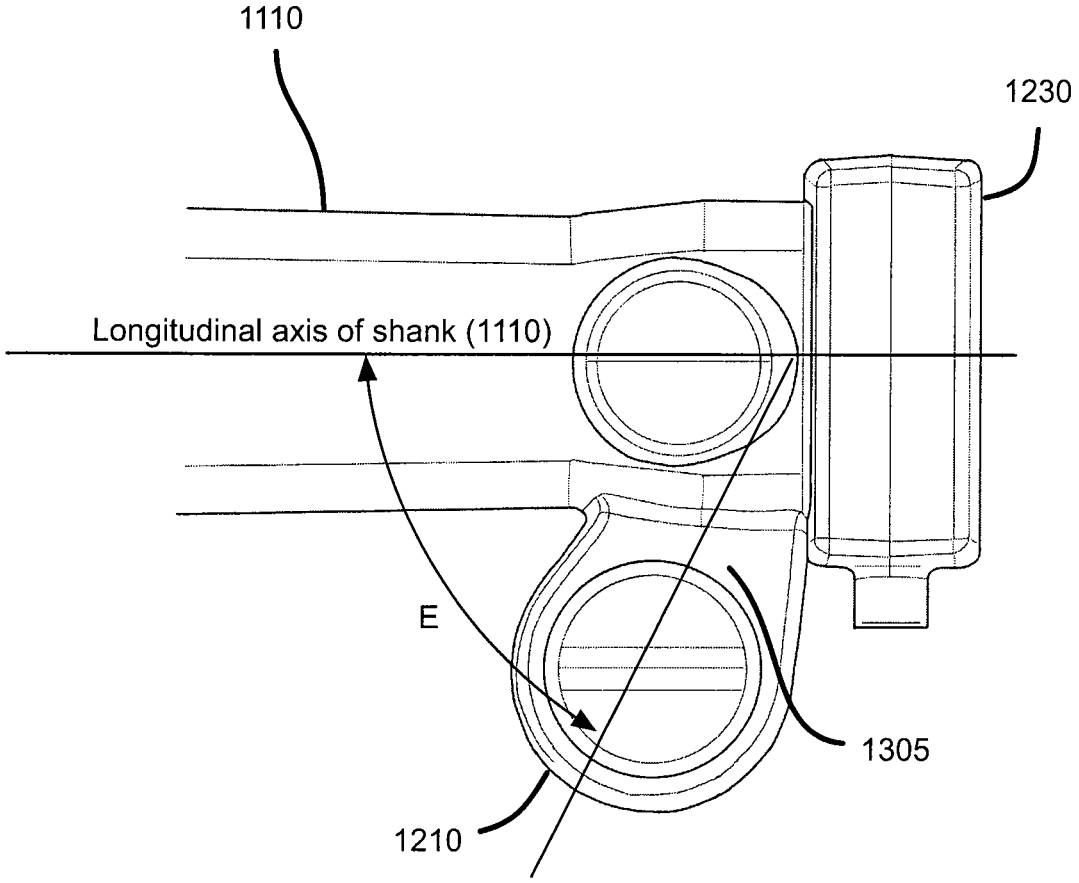

The tail riser 1210 is positioned at the end of the shank 1110, opposite the head 1105, and offset to the side of the shank 1110 so that it feeds the end of the shank though a channel 1305. The longitudinal axis of the channel 1310 forms an angle E of less than 90° with the longitudinal axis of the shank 1110, as illustrated in FIG. 13B. The tail riser 1210 has a height and diameter of about 6.3 in and 5 in, respectively. The tail riser 1210 facilitates continuous feeding of molten metal into the mold while the metal solidifies for the relatively long shank 1110. Offsetting the riser 1210 to the side allows for a more compact mold.

Figure 16:
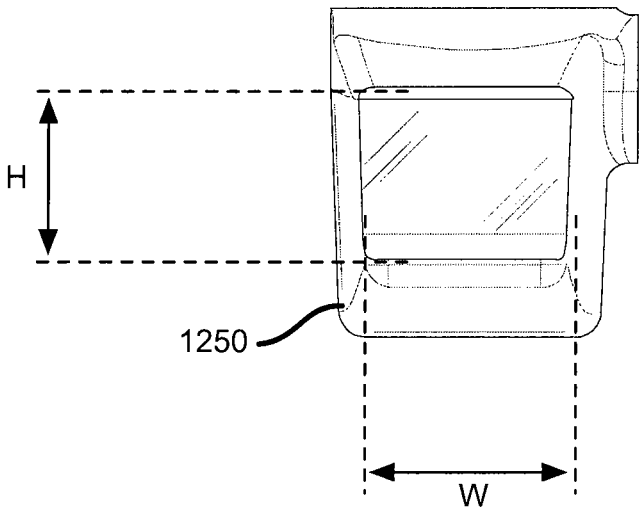
FIG. 16 illustrates a side view of the in-gates of the gating system.

The in-gates 1250 are formed in both the drag portion and cope portion of the outer mold to promote bottom feeding of the metal into the shank 1110. The angle, B, formed between the longitudinal axis of a given in-gate 1250 and the longitudinal axis of a given runner 1245 may be about 90 degrees. Referring to FIG. 16, each in-gate 1250 may have a height H of about 3.5 in and a width W of about 4.5 in.

In operation, molten material is poured into the down sprue 1215. The molten material then flows through the runners 1245 and into the risers 1220. The molten material then flows through the in-gates 1250 and then into the cavities between the cores and the outer mold to define the couplers 1100. The molten material continues to flow into the head 1105 through the front face gating system 705. As the cavities in the mold fill, molten material starts to fill the risers 1220 in the center gating system 1240, front face riser 1235, knock-off top riser 1205, tail riser 1210, and finally through the front face gating system 705, as described above. The head pressure at the opening in the top of the down sprue 1215 forces substantially the entire space within the risers 1220 to fill with molten material.

The small diameter of the first runner section 1410 tends to control the rate at which molten material flows into the second runner section 1405, which is larger, and then into the respective cavities that define the first and second couplers 1100, illustrated in FIG. 3. The restriction in flow allows the molten material to flow more evenly into the respective cavities that form the two couplers 1100.

As shown above, the casting system advantageously allows for the casting of two couplers 1100 in a single casting operation. Due to the relative positioning of the couplers 1100, the center gating system 1240, and the availability of the front face gating system 705, the size of the outer mold can be kept to a minimum. For example, the surface area of the top surface of the cope may be about 23 $ft^2$, as illustrated by reference D in FIG. 13A.

Figure 17:
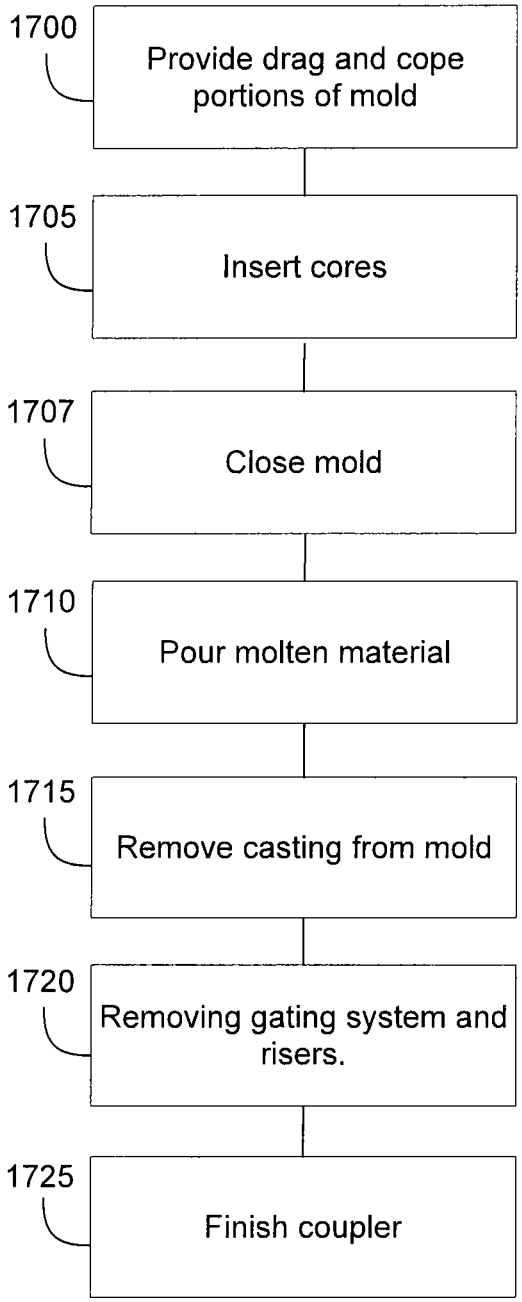
FIG. 17 illustrates operations for manufacturing the couplers of FIGS. 1 and 11.

FIG. 17 is a block diagram of operations that may be performed for casting the couplers 100 and 1100, described above. At block 1700, cope and drag portions of an outer mold are provided. The cope and drag portions may be formed from relatively inexpensive materials such as an air-set or pep-set material. Reclaimed material from previous casting operations may be utilized for part of the outer mold. The cope and drag portions are patterned to cast a pair of couplers, a gating system, and risers.

The gating system is formed in both the cope and drag portions of the outer mold and is configured to direct molten material into two cavities that define the exterior of the couplers. The gating system includes a down sprue, a pair of runners, and fin in-gates or in-gates. The gating system is configured so that molten material poured via the down sprue travels through the runners, then the fin in-gates or in-gates, and finally into the cavities that define couplers.

In a first embodiment, fin in-gates 405 are utilized and may be entirely patterned in the drag portion of the outer mold. The fin in-gates are arranged so that an angle formed between the longitudinal axis of a given fin in-gate and the longitudinal axis of a runner may be about 60 degrees. Likewise, the angle formed between the longitudinal axis of a given fin in-gate and the longitudinal axis of the shank of the coupler may be about 60 degrees.

In a second embodiment, in-gates 1250 are utilized and may be entirely formed in one or the other portion of the outer mold. The angle formed between the longitudinal axis of a given fin in-gate 1250 and the longitudinal axis of a given runner may be about 90 degrees.

At block 1705, the head core, butt-end core, and other cores (e.g., fin cores etc.) may be inserted into the outer mold. The head core is configured to define the interior surface of the head of the coupler and also defines a cavity in an interior region of the head core configured to serve as a front face gating system for feeding molten material throughout the head. The front face gating system may include an upper in-gate and a lower in-gate configured to feed molten material into upper and lower portions, respectively, of the head of the coupler. The head core may include an opening positioned below a riser formed in the cope portion.

At block 1707 the mold is closed. At block 1710, molten material is poured into the down sprue of the outer mold. The molten material flows through the gating system and into the cavities formed between the outer mold and the cores, as well as the risers. Molten material also flows through the front face gating system to define the interior features of the head of the coupler.

At block 1715, the hardened casting is removed from the mold. For example, the mold may be broken apart to expose the casting. The spent mold may be broken down and reused to form subsequent molds.

At block 1720, the couplers are separated from the gating and risers. For example, the gating systems in the head and along the shank may be hammered to break the connection formed between the respective systems and the coupler.

At block 1725, the couplers are finished. For example, the sides of the coupler shanks to which the fin in-gates are connected may be ground to a relatively smooth finish. The inner surface of the head may be finished to remove residual material from the in-gates of the front face gating system. Residual material from the knock-off top riser may be ground as well. The remainder of the coupler may then be sand blasted to a smooth surface finish. Other finishing operations, such as weld repair, heat-treating, gauging, etc. may also be performed. The coupler may be ready for operational use after the finishing operations.

As described, the embodiments facilitate forming the couplers in a minimum of space and a minimum of finishing. While various embodiments of the embodiments have been described, it will be apparent to those of ordinary skill in the art that many more embodiments and implementations are possible that are within the scope of the claims. The various dimensions described above are merely exemplary and may be changed as necessary to facilitate casting different components. Accordingly, it will be apparent to those of ordinary skill in the art that many more embodiments and implementations are possible that are within the scope of the claims. Therefore, the embodiments described are only provided to aid in understanding the claims and do not limit the scope of the claims.

We claim:

1. A casting and rigging apparatus for casting a railcar coupler, the railcar coupler including a shank portion and a head portion, the casting apparatus comprising:

cope and drag portions that define an external shape of the coupler;

one or more cores that define an interior of the shank portion; and a head core with an exterior that defines exterior surface features of the head portion that include surfaces of a lock chamber, a guard arm side portion, and a knuckle side of the head portion, wherein the head core comprises at least one portion exterior to a front face of the head portion and extending between the guard arm side portion and knuckle side of the head that defines a front face gating system that includes a channel that runs in a generally vertical direction through a center of the at least one portion exterior to a front face of the head portion and extending between the guard arm side portion and knuckle side of the head and at least one in-gate configured to direct molten material to top and bottom regions of the head portion to define the lock chamber, guard arm side portion, and knuckle side of the head.

2. The casting and rigging apparatus according to claim 1, wherein a height and width of the at least one in-gate are about 1.8 in and 2.6 in, respectively.

3. The casting and rigging apparatus according to claim 2, wherein the front face gating system comprises a second in-gate, wherein the first in-gate is positioned in the cope portion, and the second in-gate is positioned in the drag portion, wherein a height and width of the second in-gate are about 2.7 in and 2.9 in, respectively.

4. The casting and rigging apparatus according to claim 1, wherein the cope portion defines a riser configured to feed molten material to the head portion through a contact area on an upper surface of the head of the coupler, wherein a height of the riser is about 6.7 in, a top diameter is about 4.6 in, and a bottom diameter is about 1.5 in.

5. The casting and rigging apparatus according to claim 1, further comprising a down sprue into which molten material is poured that is positioned adjacent to the shank portion, and wherein the cope portion defines a front face riser that receives the molten material and that is configured to feed the molten material into the front face gating system as the molten material cools.

6. The casting and rigging apparatus according to claim 5, wherein the front face riser is positioned substantially directly over the channel.

7. The casting and rigging apparatus according to claim 6, further comprising a knockoff riser positioned over the head portion, and adjacent to the front face riser.

8. The casting and rigging apparatus according to claim 1, wherein the channel has a cross-section of about 16 $in^2$ near a parting line of the channel, and the height of the channel is between about 10 in and 15 in high.

9. The casting and rigging apparatus according to claim 1, wherein the one or more cores that define the interior of the shank portion include a butt-end core that also defines an exterior surface of a tail end of the shank.

10. The casting and rigging apparatus according to claim 1, wherein the head core comprises at least two portions.

11. A casting method for casting a railcar coupler that includes a shank portion and a head portion , the casting method comprising:

providing cope and drag portions that define an external shape of the coupler;

providing one or more cores that define at least a portion of an interior of the shank portion; and providing a separate head core with an exterior that defines exterior surface features of the head portion that include surfaces of a lock chamber, a guard arm side portion, and a knuckle side the head, wherein the head core comprises at least one portion exterior to a front face of the head portion and extending between the guard arm side portion and knuckle side of the head that defines a front face gating system that includes a channel that runs in a generally vertical direction through a center of the at least one portion exterior to a front face of the head portion and extending between the guard arm side portion and knuckle side of the head and at least one in-gate configured to direct molten material to top and bottom regions of the head to define the lock chamber, guard arm side portion, and knuckle side of the head.

12. The casting method according to claim 11, wherein a height and width of the at least one in-gate are about 1.8 in and 2.6 in, respectively.

13. The casting method according to claim 11, wherein the front face gating system comprises a second in-gate, wherein the first in-gate is positioned in the cope portion and the second in-gate is positioned in the drag portion, wherein a height and width of the second in-gate are about 2.7 in and 2.9 in, respectively.

14. The casting method according to claim 11, wherein the cope portion defines a riser configured to feed the head through a contact area on an upper surface of the head of the coupler, wherein a height of the riser is about 6.7 in, a top diameter is about 4.6 in, and a bottom diameter is about 1.5 in at the bottom to facilitate removal of the riser via impact.

15. The casting method according to claim 11, further comprising pouring molten material into the casting apparatus via a down sprue positioned adjacent to the shank portion, wherein the cope portion defines a front face riser that receives the molten material and feeds the molten material into the front face gating system as the molten material cools.

* * * * *